US006367943B1

(12) United States Patent
Tocci et al.

(10) Patent No.: US 6,367,943 B1
(45) Date of Patent: Apr. 9, 2002

(54) RIOT OR CAPTURE SHIELD WITH INTEGRATED BROAD-AREA, HIGH-INTENSITY LIGHT ARRAY

(75) Inventors: Nora C. Tocci, Sandia Park; Eric J. Cramer, Albuquerque; John D. German, Cedar Crest; Brian C. Yates, Placitas; Michael D. Tocci, Sandia Park, all of NM (US)

(73) Assignee: Science & Engineering Associates, Inc., Albuquerque, NM (US)

( * ) Notice: Subject to any disclaimer, the term of this patent is extended or adjusted under 35 U.S.C. 154(b) by 0 days.

(21) Appl. No.: 09/545,209

(22) Filed: Apr. 7, 2000

Related U.S. Application Data

(60) Provisional application No. 60/135,231, filed on May 21, 1999.

(51) Int. Cl.[7] ..... F21V 21/08

(52) U.S. Cl. ..... 362/103; 362/231; 362/234; 362/253

(58) Field of Search ..... 362/203, 209, 362/231, 234, 240, 248, 249, 253, 263, 351, 376, 399; 89/36.02, 36.05, 36.06, 36.07; 109/49.5

(56) References Cited

U.S. PATENT DOCUMENTS

| | | | | |
|---|---|---|---|---|
| 3,370,302 A | * | 2/1968 | Karlyn | 89/36.05 |
| 3,476,107 A | * | 11/1969 | Matt, Jr. et al. | 89/36.05 |
| 4,843,947 A | | 7/1989 | Bauer et al. | 89/36.05 |
| 5,056,155 A | | 10/1991 | Truxell | 2/2 |
| 5,072,342 A | | 12/1991 | Minovitch | 362/111 |
| 5,241,703 A | | 9/1993 | Roberts et al. | 2/2 |
| 5,243,894 A | | 9/1993 | Minovitch | 89/1.11 |
| 5,641,934 A | | 6/1997 | Follett | 89/36.05 |
| 5,685,636 A | | 11/1997 | German | 362/259 |
| 5,787,820 A | | 8/1998 | Dittoe | 109/49.5 |
| 5,808,226 A | | 9/1998 | Allen et al. | 89/1.11 |
| 5,823,849 A | * | 10/1998 | Gardner et al. | 446/473 |
| 5,850,052 A | | 12/1998 | Gabriel | 89/36.05 |
| 6,007,218 A | | 12/1999 | German et al. | 362/259 |

* cited by examiner

*Primary Examiner*—Y. My Quach-Lee
(74) *Attorney, Agent, or Firm*—Perkins, Smith & Cohen, LLP; Jerry Cohen; Jacob N. Erlich

(57) ABSTRACT

A shield in combination with a plurality of high-brightness light sources used for riot, capture or other control of individuals. The light array utilizes a plurality of high-brightness light sources to provide a broad-area, high-intensity light for visual countermeasures. By providing a sudden burst of very bright light to surprise a subject and cause the subject to look away or close his or her eyes, the overseer, such as a police officer, can cause sufficient distraction to effectively capture or control the subject without harm.

40 Claims, 18 Drawing Sheets

RIOT OR CAPTURE SHIELD WITH INTEGRATED BROAD-AREA, HIGH-INTENSITY LIGHT ARRAY

CROSS REFERENCE TO RELATED APPLICATIONS

This application claims priority of U.S. Provisional Application S. No. 60/135,231 filed May 21, 1999 entitled RIOT OR CAPTURE SHIELD WITH INTEGRATED BROAD-AREA, HIGH INTENSITY LIGHT ARRAY.

BACKGROUND OF THE INVENTION

This invention relates generally to an apparatus for controlling individuals, and, more particularly, to a non-injurious method and apparatus for aiding in prison cell extraction or riot control through the use of a high-intensity light in conjunction with a standard riot or capture shield.

It has become increasingly common for law enforcement and corrections officers to be put into dangerous situations. On a daily basis corrections officers are faced with the task of extracting an uncooperative, and sometimes armed, inmate from his cell. This common practice often proves dangerous for both the officer and the inmate. Normal operations call for a team of several officers to go into the cell and use a "capture" shield in an attempt to pin the subject down. This capture shield consists simply of a curved piece of clear plastic with two handles. The plastic is curved outward to allow the officer to entrap the struggling subject against a wall or floor. It is common to use the capture shield in conjunction with gas, pepper spray or even high-voltage electricity to temporarily incapacitate the subject. Using these options can prove unsafe to not only the inmate, but to the corrections officer as well.

It is therefore an object of this invention to increase the effectiveness of the standard riot or capture shield by providing a high-intensity, broad-area light source to deter, distract and disorient.

It is another object of this invention to provide a high-intensity, broad-area light source that is capable of flickering on and off automatically.

It is still another object of this invention to utilize high-intensity, broad-area light sources made up of one or more different colors.

It is also an object of this invention to provide a system for protecting the light source and other associated components of the invention from stresses and strains of a shield undergoing deformation or puncture.

SUMMARY OF THE INVENTION

The objects set forth above as well as further and other objects and advantages of the present invention are accomplished by the embodiments of the invention described hereinbelow.

The present invention utilizes an array of a plurality of high-brightness light sources to provide a broad-area, high-intensity light for visual countermeasures. These arrays produce a sudden burst of very bright light to surprise the subject and cause him (refers to both sexes) to look away or close his eyes. This gives the officer the needed distraction to effectively capture the subject without harm.

High-brightness light sources such as Light-Emitting Diodes (LEDs) or lasers offer a number of options to control dangerous situations. Light sources can be used as a non-lethal means of force and provide (1) a language-independent, unequivocal warning, (2) psychological impact such as distraction and fear, (3) temporary visual impairment, (4) physiological response such as disorientation and/or nausea, and (5) a reduction in the ability of subjects to perform violent acts.

The present invention is directed to a capture or riot shield in combination with these high brightness light sources, such as light emitting diodes or lasers in order to illuminate the area in the vicinity of an adversary and thus subject the adversary or adversaries to the effects of such light sources. The LED arrays or lasers operate in numerous modes. Although the invention as described using LEDs, it should be realized that lasers may also be acceptable under certain circumstances.

In an embodiment of the present invention, the LED array is placed in the back of the shield and is therefore protected by the shield itself while the user controls the operation of the LEDs by switches located on or near the handles of the shield. In the case of a capture shield, because of the uniquely designed mounting system, flexure of the shield does not disrupt the operation of the LEDs or damage them. In a further embodiment of the present invention, a series of LED arrays are utilized. A still further embodiment of the present invention provides, in kit form, components which can be easily mounted on a conventional capture or riot shield to aid in capture or crowd control.

In addition, the shield may be in the form of a smaller hand-held protective shield incorporating therein an LED array similar to its use with the larger capture or riot shield. Furthermore, the power source for actuating and operating the LED source may be removed from the shield and attached to the user's body in order to lighten the weight of the shield and make the shield more easily usable during confrontations.

For a better understanding of the present invention, together with other and further objects thereof, reference is made to the accompanying drawings and detailed description and its scope will be pointed out in the appended claims.

DETAILED DESCRIPTION OF THE PREFERRED EMBODIMENTS

Figure 1:
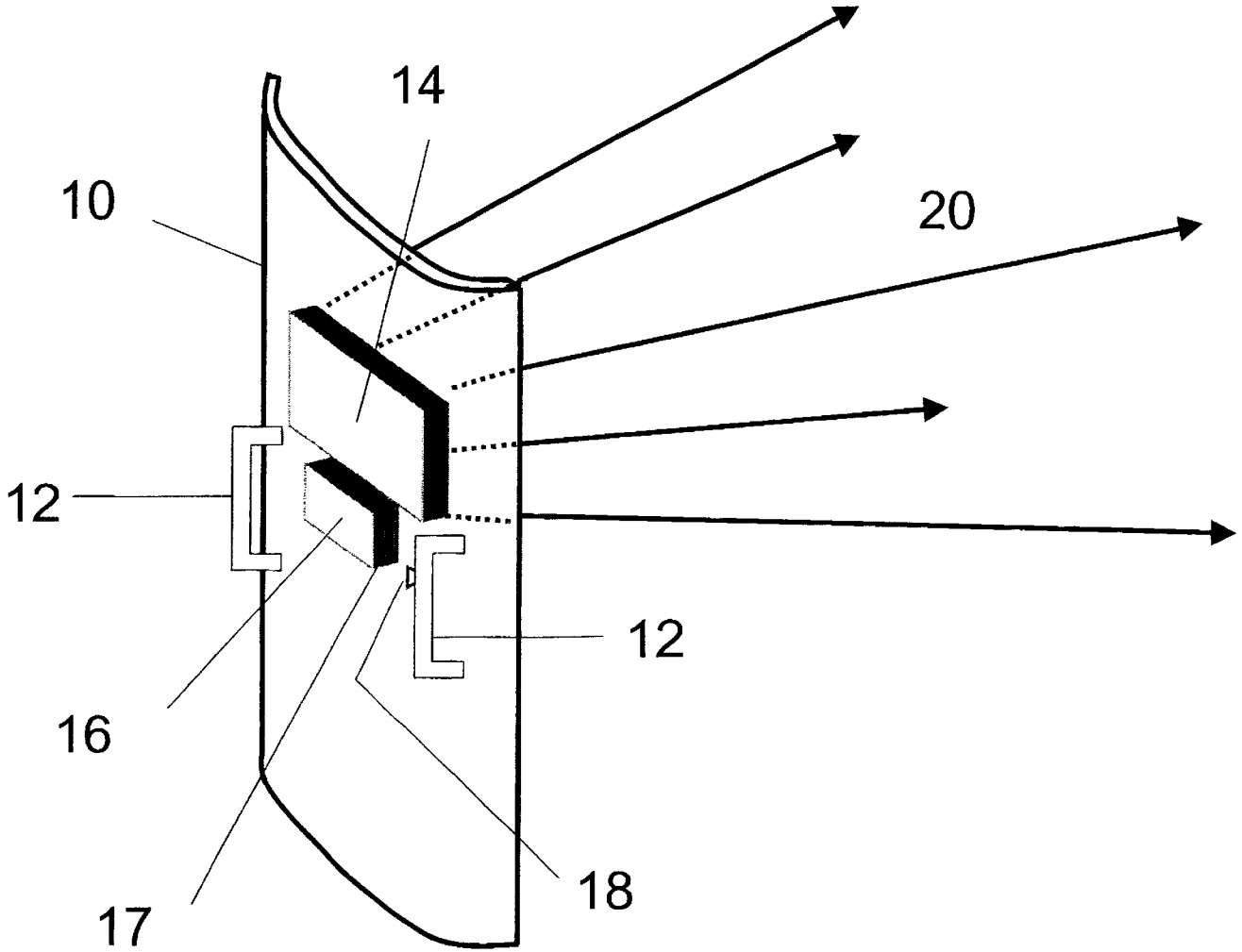
FIG. 1 is a pictorial representation of the preferred embodiment of the present invention.

In the preferred embodiment of the present invention, a conventional capture shield 10 is outfitted with an array 22 of preferably 200–2000 bright, light sources such as, for example, 1000 LEDs (preferably, but not limited to, red) to provide an instant, intense, broad-area light source. FIG. 1 shows this overall inventive concept. More specifically, the present invention is incorporated as part of a capture shield 10 or a standard riot shield which is more fully described in FIGS. 14 and 15. Shield 10 is preferably made of clear, durable plastic (e.g., clear polycarbonate or Lexan®) and is equipped with sturdy handles 12. However, it should be realized that shield 10 may be made of any durable material which is transparent to the preselected wavelength(s) of the light sources. Making up this invention is a light housing 14 (more clearly described below) affixed and electrically connected to a battery/electronics housing or power supply housing 16 with a main power switch 17 shown more clearly in FIG. 6. A three position action switch 18 located on one of the handles 12 is normally in the central, "power off" position. When the action switch 18 is pressed in one direction, the LED array turns on with continuous light output. It should be noted that the exact location of the switches may vary within the scope of the invention. When action switch 18 is pressed in the opposite direction, the LED array flickers on and off at a rate between 4–40 times per second. The preferable rate is 18 flashes per second. If action switch 18 is positioned for either the continuous or flicker mode, then an instant bright light 20 is produced. This illumination 20 shines outward, away from the user, and is directed at the adversary.

Figure 2:
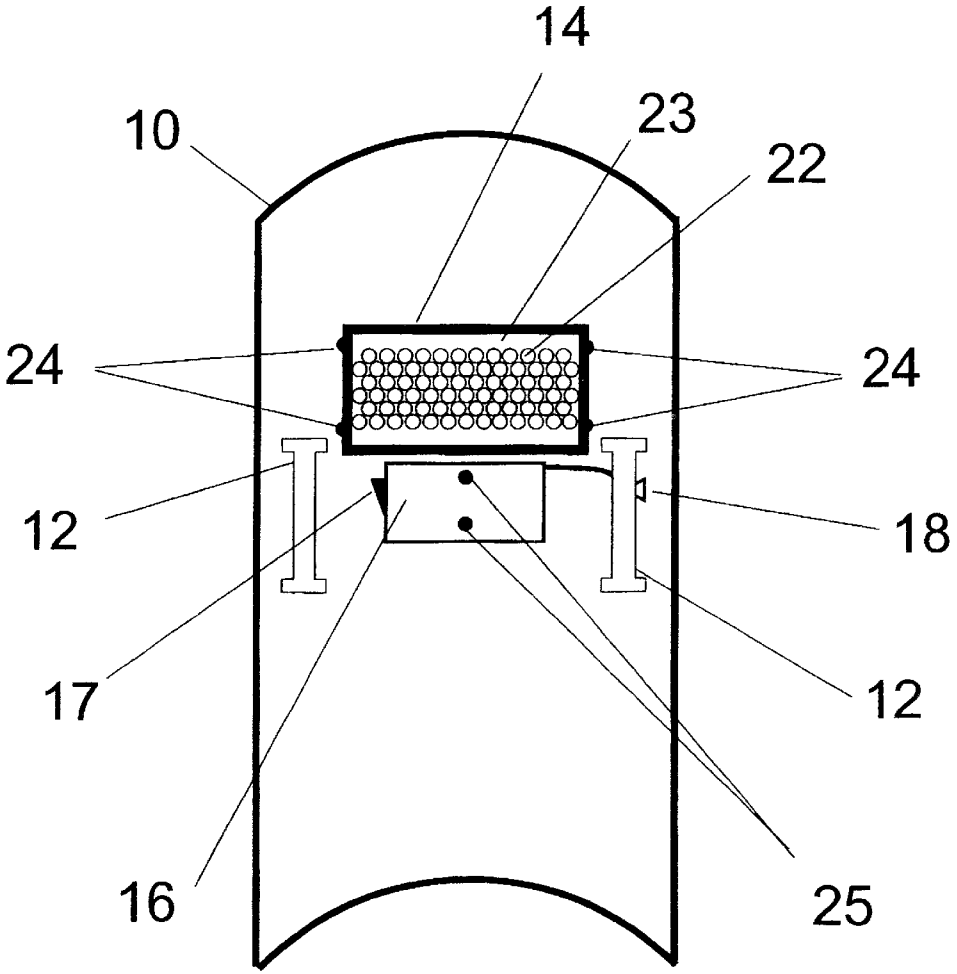
FIG. 2 is pictorial representation of a front view of the preferred embodiment of the present invention.

FIG. 2 is a front view of the shield 10. The light housing 14 contains an array 22 of a plurality of individually lensed LEDs 23 (such as Gilway Technical Lamp, E-184, Red LED). The LED array 22 is firmly mounted to the light housing 14. The light housing 14 is mounted using any suitable fastening means such as mounting screws 24 (seen clearly in FIGS. 3A and 4) such that shield 10 is allowed to undergo normal flexure during use and mounting screws 24 will not loosen or damage shield 10. The battery/electronics housing 16 is also securely fastened to the shield using suitable securing means such as mounting screws 25. Note that the battery/electronics housing mounting screws 25 are preferably placed along the center vertical axis of the battery/electronics housing 16 as shown in FIG. 2. The purpose for this specific placement of the battery housing mounting screws 25 is to allow firm attachment of the heavy battery housing 16 to the shield 10, while preventing stress and strain on the battery housing 16 during flexure of the shield 10. The battery housing 16 has a main power switch 17 located on the side. While the main power switch 17 is turned off, the LED array 22 cannot be turned on with the action switch 18.

Figure 3A:
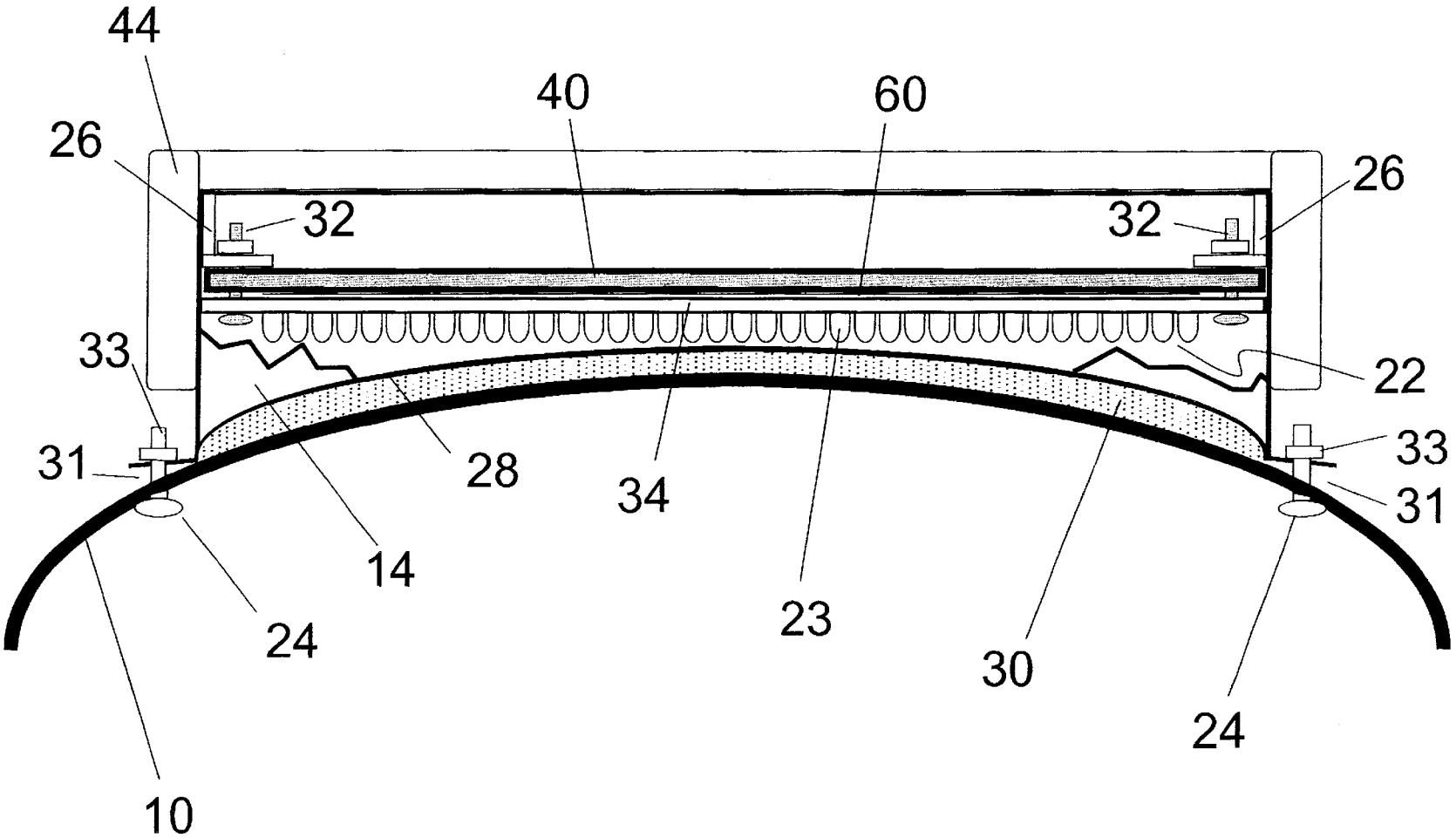
FIG. 3A is a sectioned top view representation of the housing and shield interface of the preferred embodiment of the present invention, with the shield at normal curvature.
Figure 3B:
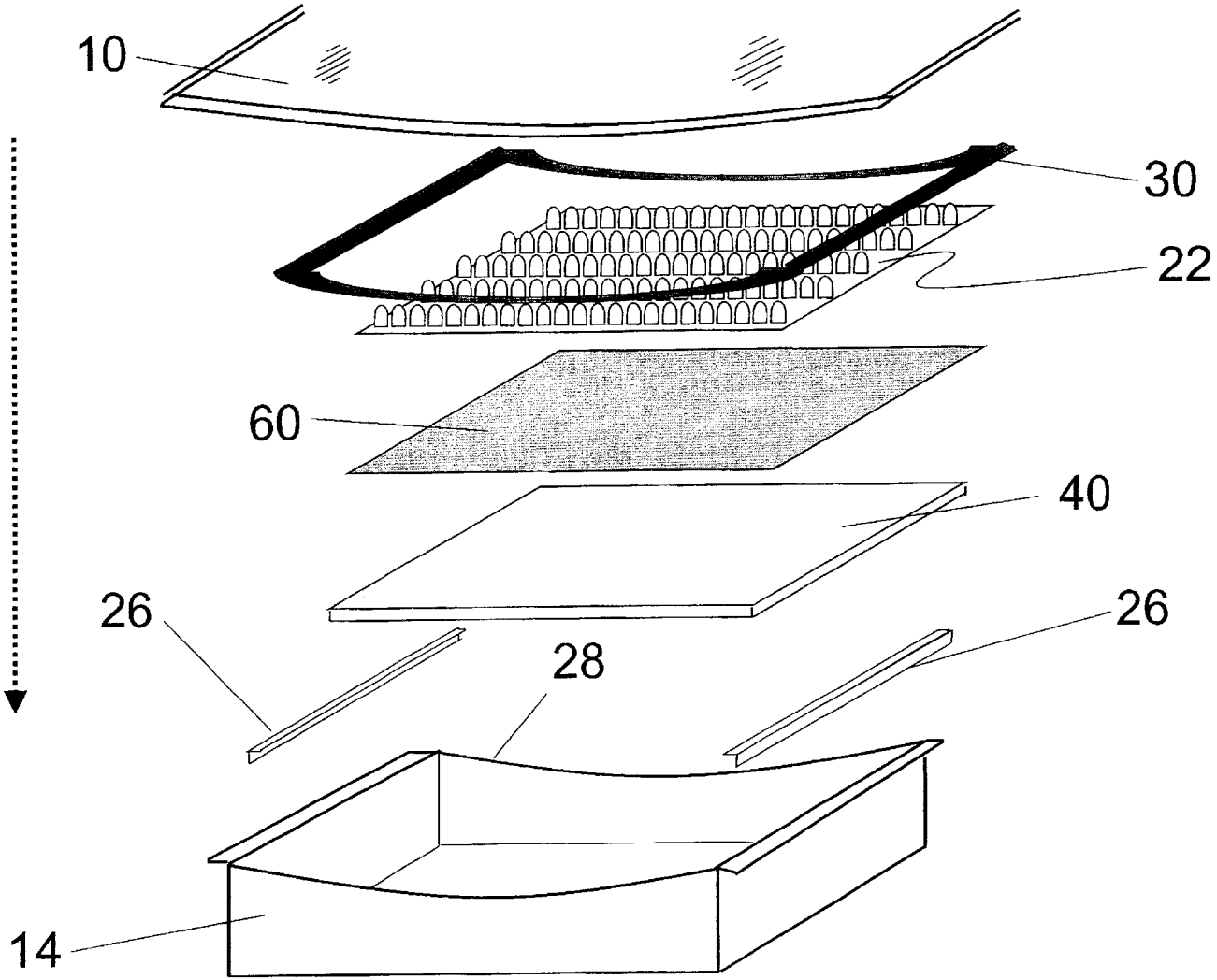
FIG. 3B is an exploded pictorial view of some of the major components of the capture shield of this invention and as shown in FIG. 3A.

It is important to note that this system must be rugged in order to withstand the forces exerted upon it during actions such as cell extractions. The shield 10 flexes when force is placed on the handles and when "capturing" an inmate. The battery housing 16 is mounted in the center to accommodate such flexing in the shield 10. FIG. 3A depicts a close-up, top view of the light housing 14 and shield 10 interface of the present invention with the shield 10 in an "unflexed" or naturally curved (concave on the exterior) position while FIG. 3B illustrates some of the major components of this invention in exploded fashion. The LED array 22 is preferably made up of 200–2000 individual LEDs 23 (but could vary further in number depending on brightness and cost limitations), however this number may vary within the scope of this invention. The LEDs 23 are mounted and electronically connected via a Printed Circuit Board (PCB) 34. Note that all LEDs 23 may be the same color (for example, red) or they may be made up of individual LEDs 23 of different colors (for example, red and green). The different colored LEDs may be arranged randomly or in a fixed pattern. This concept is described in detail below.

The LED array 22 is secured to a mounting plate 40. Between the LED array 22 and the mounting plate 40, a thermally conductive foam 60 (such as Chomerics, #691220685A574) is used as a heatsink material to aid in cooling the array 22. This "sandwich" arrangement (LED array 22, thermally conductive foam 60, and mounting plate 40) is then securely fastened to the mounting brackets 26 of light housing 14 using suitable fastening means such as mounting screws 32. The light housing 14 is, in turn, attached with mounting screws 24 or other mounting system to shield 10 such that shield 10 is able to undergo normal flexure without being damaged. The light housing 14 is covered with a padding such as a thick neoprene style foam 44 or other suitable resilient padding in order to protect the user from the edges of the light housing 14. Note that there is a significant gap 31 between the shield 10 and the lock-nut 33 when the shield 10 is in an "unflexed" or naturally curved state. In this natural position the curved front perimeter or edge 28 of the light housing 14 comes in contact with neoprene foam 30 or other similar padding, which is securely affixed to the shield 10. In the "unflexed" position the distance between the shield 10 and the curved (concave on the exterior) front perimeter or edge 28 of the light housing 14 is very small, and the neoprene foam 30 is compressed.

Figure 4:
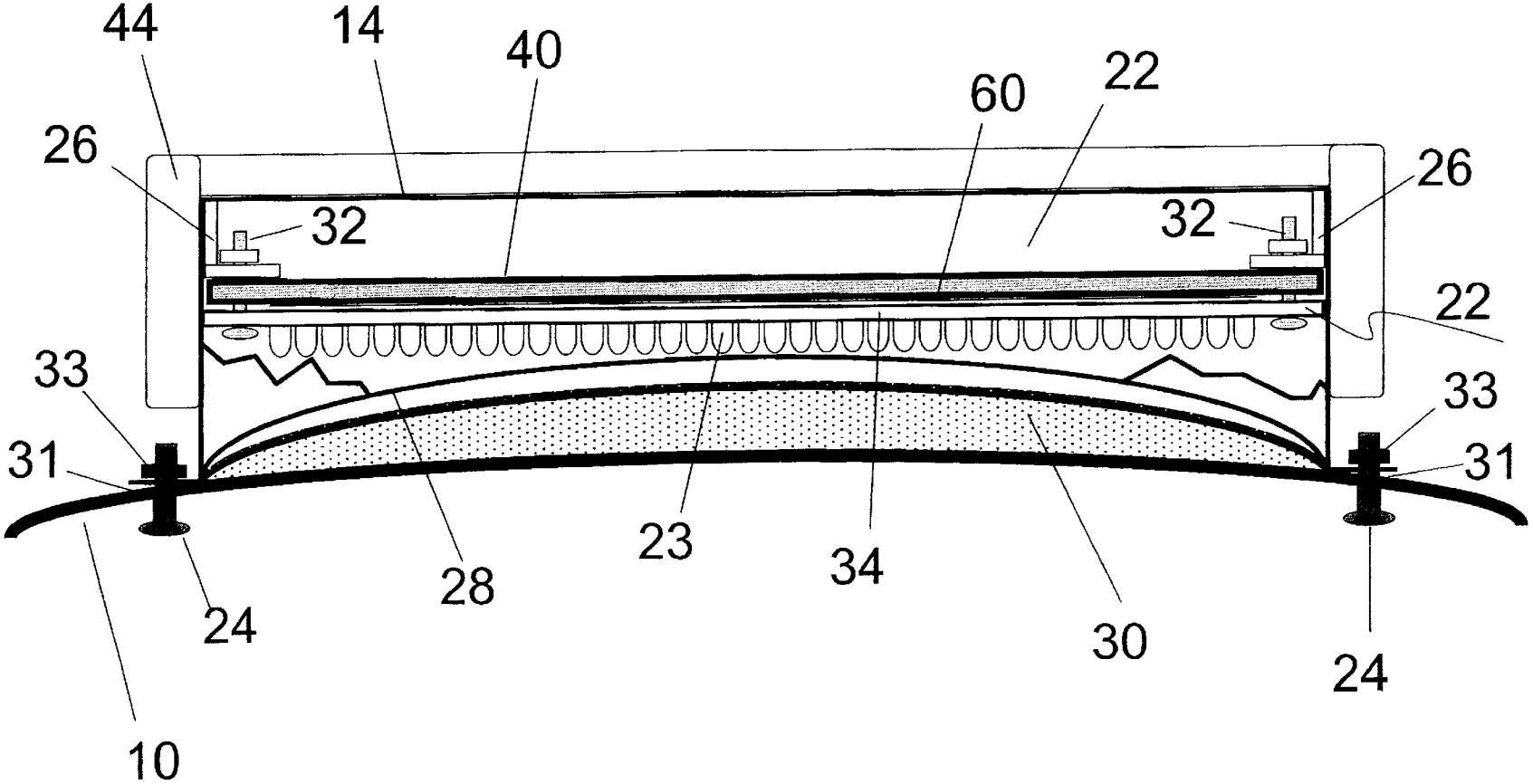
FIG. 4 is a sectional top view of the housing and shield interface of the preferred embodiment of the present invention, with the shield undergoing flexure.

FIG. 4 depicts a sectional, top view of the light housing 14 and shield 10 interface of the present invention with the shield 10 in a "flexed" or stressed position. Note that the size of the gap 31 between the lock-nut 33 and the shield 10 decreases significantly, thereby preventing stress and strain on the light housing 14 and its associated components when the shield 10 undergoes flexure. As the shield 10 flexes the present invention allows the distance between the shield 10 and the front perimeter 28 to increase in order to protect the LED array 22 from excessive bending forces. This method isolates the light array 22 from the flexing shield 10. Neoprene foam 30 is used to keep the housing from directly contacting and damaging the shield 10. During flexure of the shield 10, as the distance between the curved front perimeter or edge 28 of the light housing 14 and the shield increases, the neoprene foam 30 is allowed to expand, and helps to maintain a seal between the shield 10 and the curved perimeter or edge 28 of the light housing 14. Once again, the light housing 14 is covered with thick, neoprene style foam 44 in order to protect the user from the edges of the light housing 14.

Figure 5:
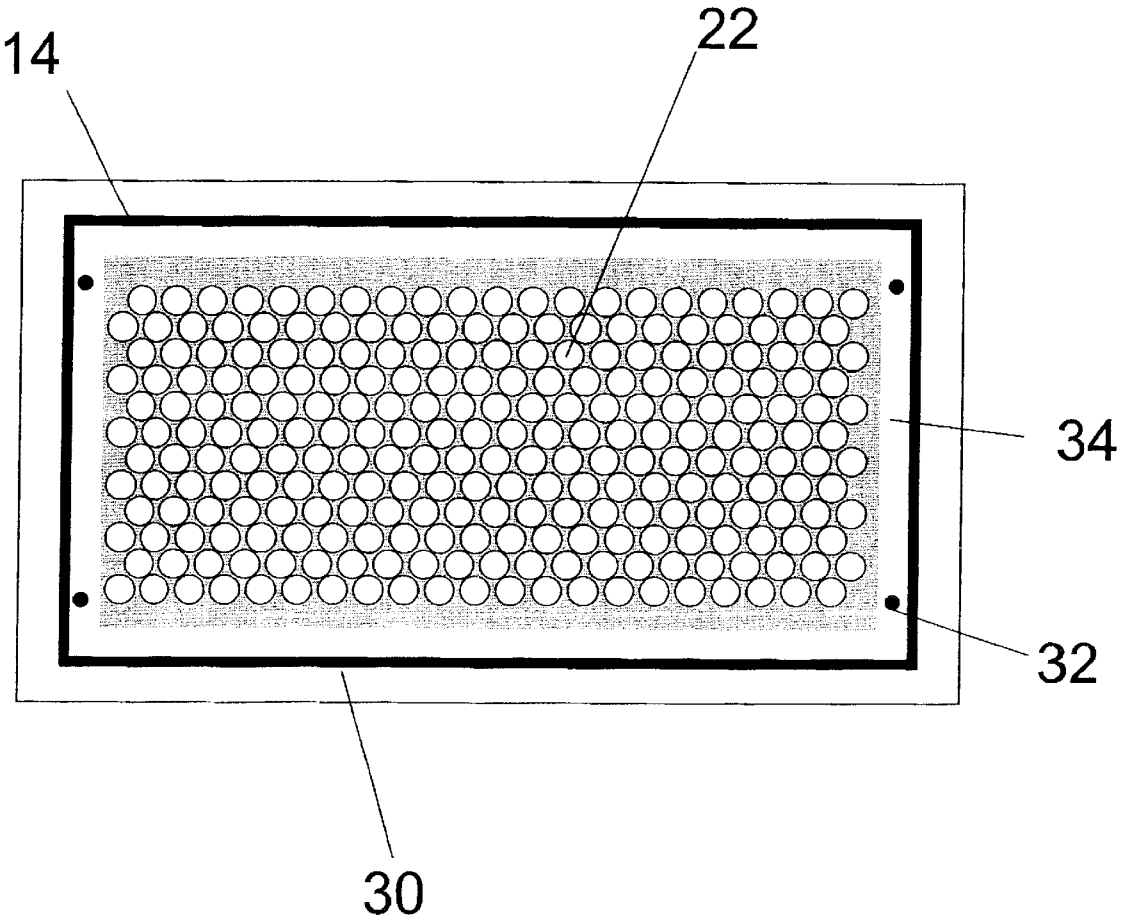
FIG. 5 is a pictorial representation of the light housing of the preferred embodiment of the present invention and other associated components.

FIG. 5 is a front-on view of the front of the light housing 14 and some of its associated components. The light housing 14 preferably contains an array of approximately 200–2000 LEDs 23 (optimally approximately 1000 LEDs) mounted on a Printed Circuit Board (PCB) 34. The size of each LED 23 is preferably approximately 5 mm in diameter. It should be noted that the above dimensions and sizes are illustrative of a preferred embodiment, however, these dimensions, sizes and exact type of LED holder may vary within the scope of this invention. The PCB 34 is firmly mounted to brackets 26 (shown in FIGS. 3A and 4) on the inside of the housing 14 using mounting screws 32. A thick neoprene foam 30 lines the outside of the housing 14 to protect the shield 10 from scratches and breakage.

The LEDs 23 shown in FIG. 5 can be utilized in a variety of ways. A further embodiment of the present invention utilizes at least two colors of light to substantially improve the effectiveness of the device when used to produce physiological disorientation in the flashing mode. The incorporation within the device of standard electronic circuitry to sequentially flash first one color light source then another color light source in repeated cycles, enables the disorientation of an adversary to be significantly greater than that produced by a single-color on-off flashing light.

By limiting the output to a single color, the device becomes vulnerable to a relatively inexpensive countermeasure: the use of protective eyewear designed to filter out or reduce the brightness of a specific wavelength in use. Laser goggles for this purpose can be purchased from Edmund Scientific (catalog item #F38237 for green sources (normally lasers) and item #F38216 for red sources). Such a countermeasure is only possible, however, if the adversary knows the wavelength in advance. Although special purpose goggles could be developed to protect the adversary from two or more different color light sources, this will also block out most of the visible light, making it difficult for the adversary to see anything. The present invention is capable of emitting two or more colors of light; either selectably, simultaneously, or sequentially in a flashing mode; and will make the use of this countermeasure impractical.

The present invention is capable of activating several modes of operation by incorporating a multi-position switch 48 (see FIG. 6) and switch 18 located on the handle. One mode of operation would allow continuous ON mode for one or more of the selected light sources. For example, red, green, or blue light sources would be emitted continuously from the device. Additionally, another mode of operation would allow for flickering (blinking) of one or more selected light emitting sources. For example, red, green or blue light sources flickering at the same time (in phase). Another mode would involve flickering selected light sources in an offset manner, perhaps completely out of phase from each other. For example, red and green light sources flickering at the same frequency such that the red source is ON while the green source is OFF, so that light emitted from the device alternates red, green, red, green, etc. Also, another mode of operation would comprise flickering selected light sources at different frequencies. For example, a red source flickers 8 times per second, a green source flickers 12 times per second and a blue source at 16 times per second. Finally, any number of modes comprising a combination of those just described. For example, a blue light emits continuously while red and green sources flicker (either at the same time, or offset, or at different frequencies).

Figure 6:
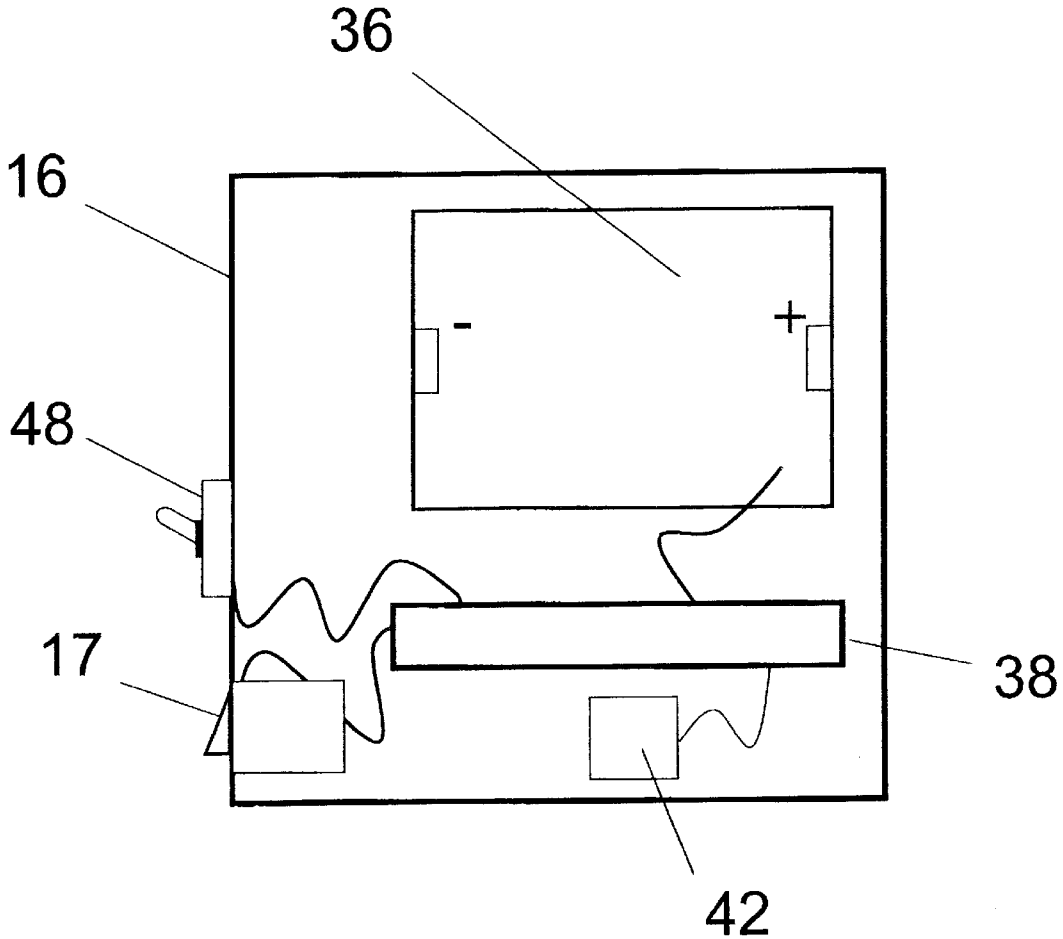
FIG. 6 is a front view representation of the battery/electronics housing of the preferred embodiment of the present invention.

FIG. 6 is an illustration of the components that reside in the battery/electronics housing 16. A lead-acid gel cell battery 36 (such as Powersonic PS-1250 F2) or other comparable power source are connected in series to a power supply circuit 38 (such as PowerCube, PD301-024-12PI) and a standard electronic flicker circuit 42. The characteristics of the power supply needed to drive the LED array 22 could vary depending on the number of LEDs used, on-time, brightness needed and other factors or specifications relevant to use. The electronic flicker circuit 42 may be made to turn all the LEDs on and off simultaneously, or it may be made to turn some LEDs off while others are on and vice versa. This may be useful in order to induce a further disorienting effect by flickering alternately-colored LEDs 23 at different frequencies, or with different phases (as described in detail above). For example, red LEDs may be turned on while green LEDs are turned off and vice versa. Or, for example, red LEDs may be flickered at 8.5 Hertz and green LEDs may be flickered at 7.5 Hertz. Or, for example, red LEDs may be on continuously while green LEDs flicker at a given frequency. Lead acid gel cell batteries 36 are preferably used with the invention because they deliver a large current at a relatively low cost, but any other suitable battery power source may suffice. The power supply circuit 38 is connected to the main power switch 17 located outside of the battery housing 16. While the main power switch 17 is in the "ON" position, the position of the action switch 18 (shown in FIG. 1) determines the function of the light array 22 (off, constant on, or flickering on and off).

Figure 7:
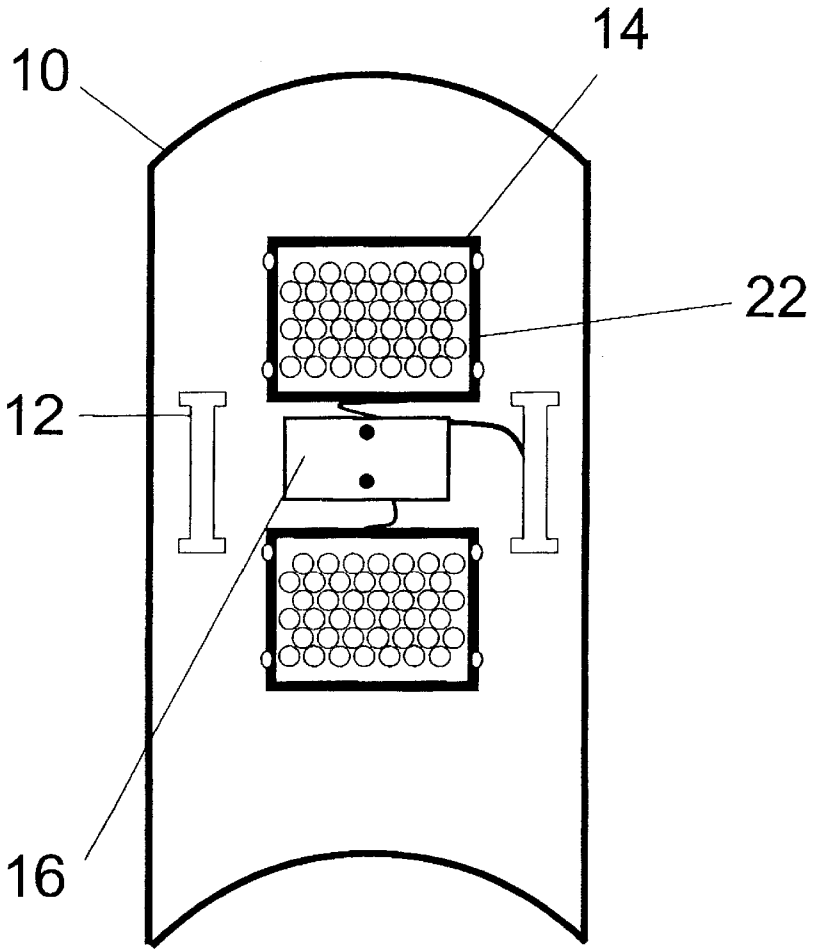
FIG. 7 is a front view representation of another embodiment of this invention.

FIG. 7 is a second preferred embodiment of the present invention in which more than one LED array 14 is used on a single shield 10. The LED arrays 14 could be of any size or shape and could use multi-colored LEDs for additional distraction or disorientation effects.

Figure 8:
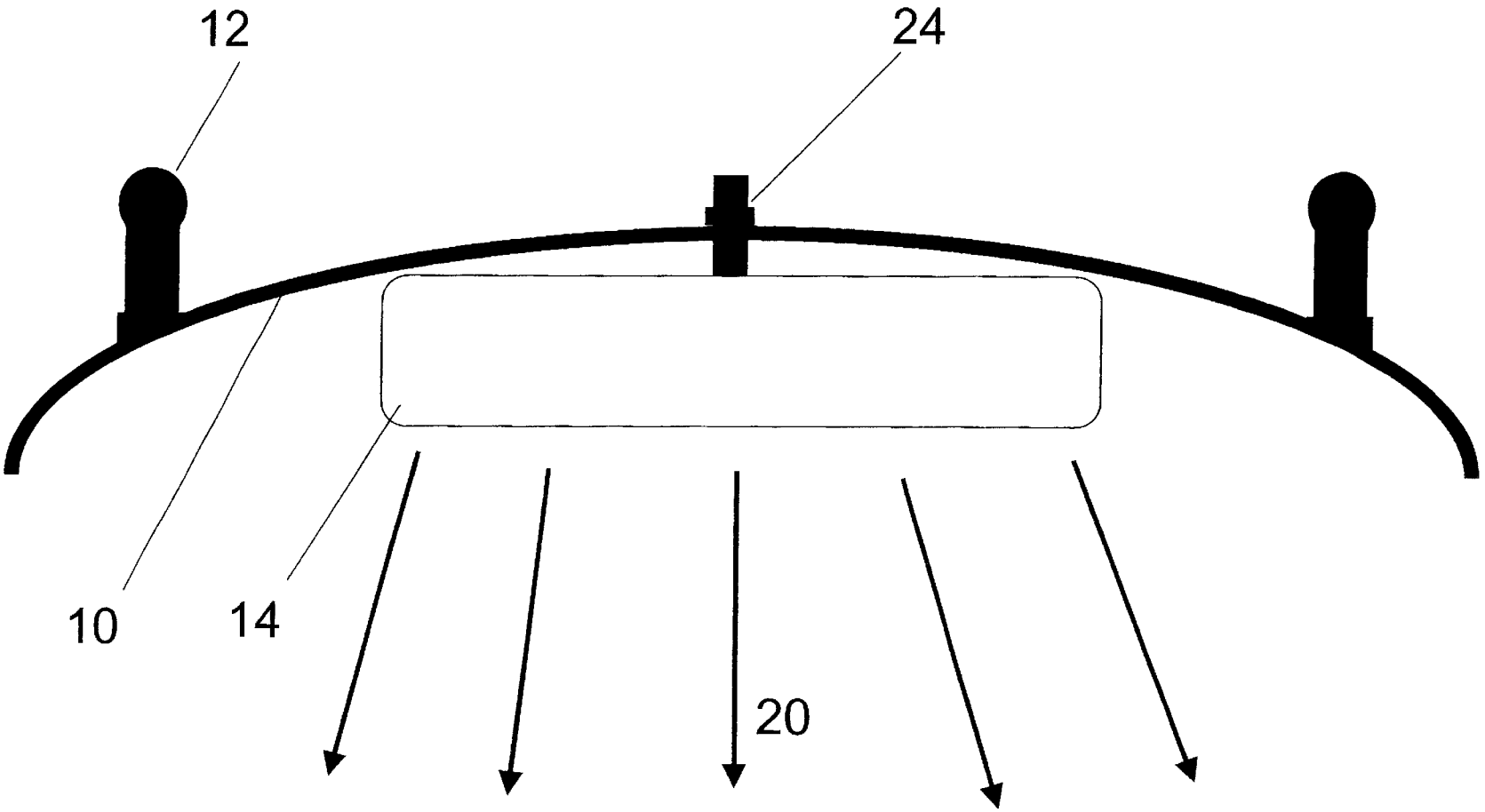
FIG. 8 is a top view of yet another embodiment of this invention.

FIG. 8 is a third embodiment of the present invention in which the LED array 14 and/or battery/electronics housing (not shown) is affixed to the external portion of the shield 10 using mounting screws 24 which produces a high-intensity, broad-area light 20. This embodiment is not recommended for close contact with an inmate or adversary, but could be used in situations such as crowd or riot control.

Figure 9:
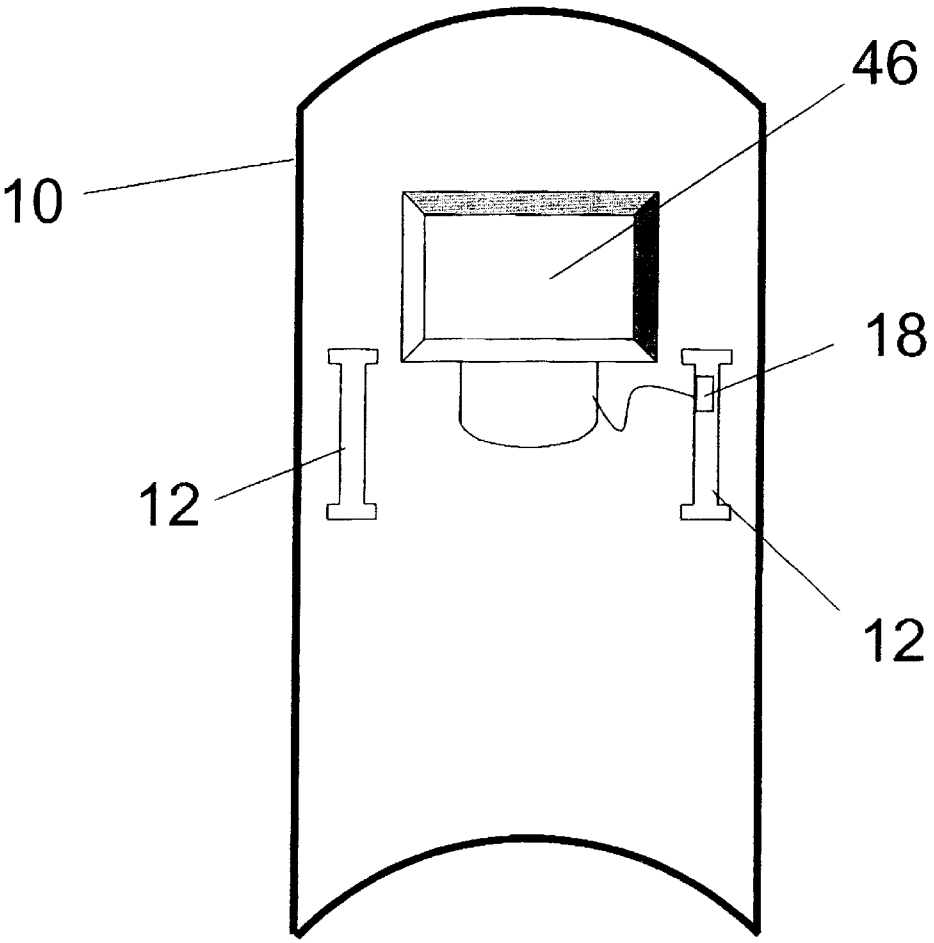
FIG. 9 is a back view representation of another embodiment of the present invention.

FIG. 9 is a fourth embodiment of the present invention in which a single housing 46 is used to contain all of the components of the system; the LED array 14, the battery 36, and power supply circuit 38. Activation of the system is obtained via a switch 18 on one of the shield 10 handles 12. It is desirable with this embodiment that the housing 46 be made from a molded, high-impact, durable plastic. It is also desirable that the housing 46 have smooth, round edges in order to be safe for the user. A protective foam (not shown, however, such as the thick, neoprene foam 44 shown in FIGS. 3 and 4) could be applied for added protection to the user.

Figure 10:
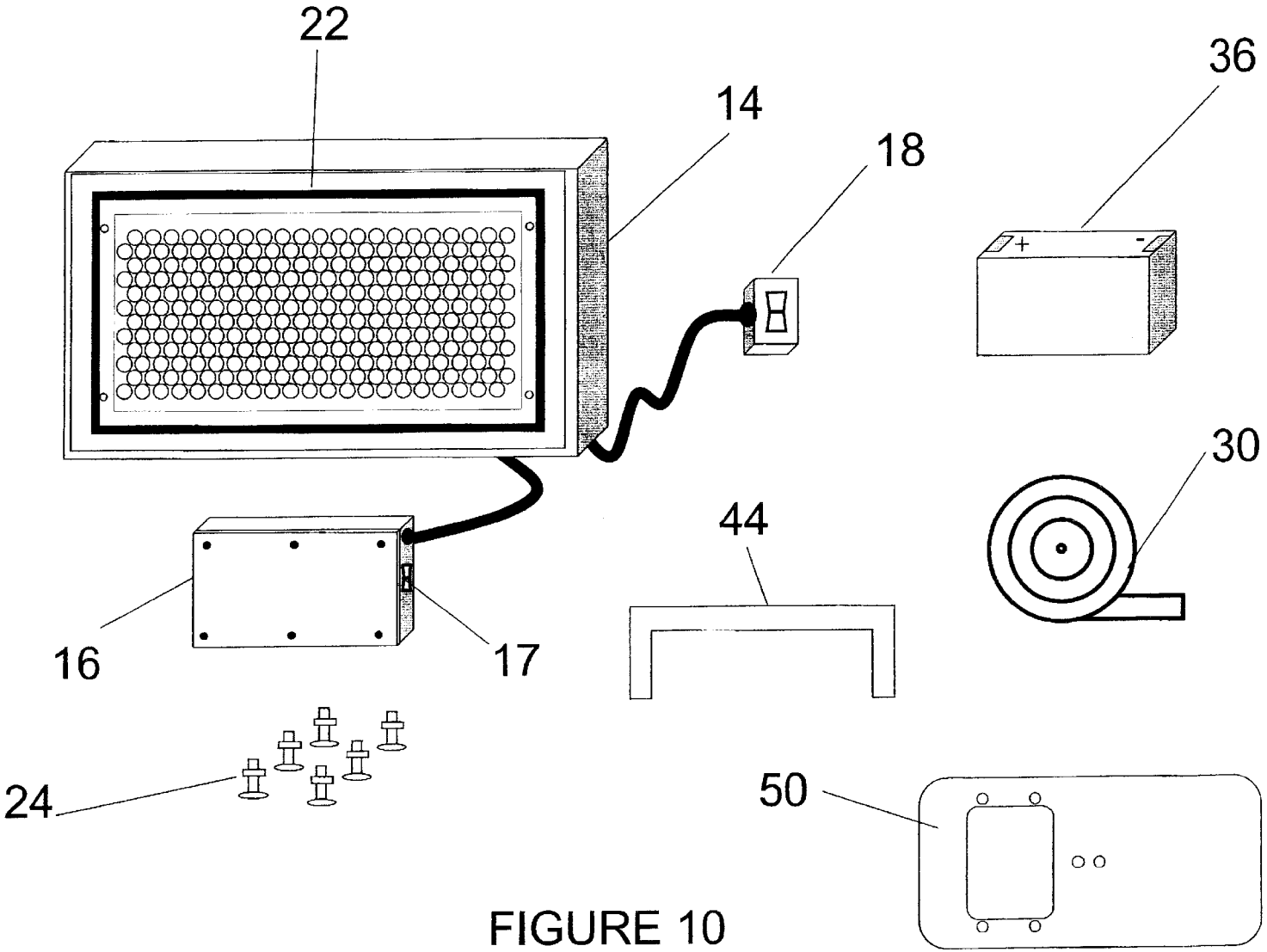
FIG. 10 shows a further embodiment of this invention in the form of a kit or modular form of this invention.

A fifth embodiment of the present invention as shown in FIG. 10 of the drawings is a modular or "kit" version. This embodiment would include one or more light housings 14 with integrated array 22, a battery housing 16, and battery 36 to be installed to a shield 10 by the user. Many users already have shields that are in use, this embodiment would allow the user to retrofit shields of their choice with a high-intensity, broad-area light source, whereby saving them the cost of the shield included in the preferred embodiment of the present invention.

Using a shield 10 currently in inventory, the user could modify the shield by drilling holes from a mounting template 50. Next, the neoprene 30 can be placed to protect the shield 10 from light housing 14. Once the holes are drilled, the light housing 14 (with LED array 22 already installed) can be installed using the provided mounting screws 24. The battery housing 16 and ON/OFF switch 17 can be installed using the same method. Finally, a protective outer neoprene cover 44 can be applied to the outside of the light housing 14 to protect the user from harsh edges.

Figure 11A:
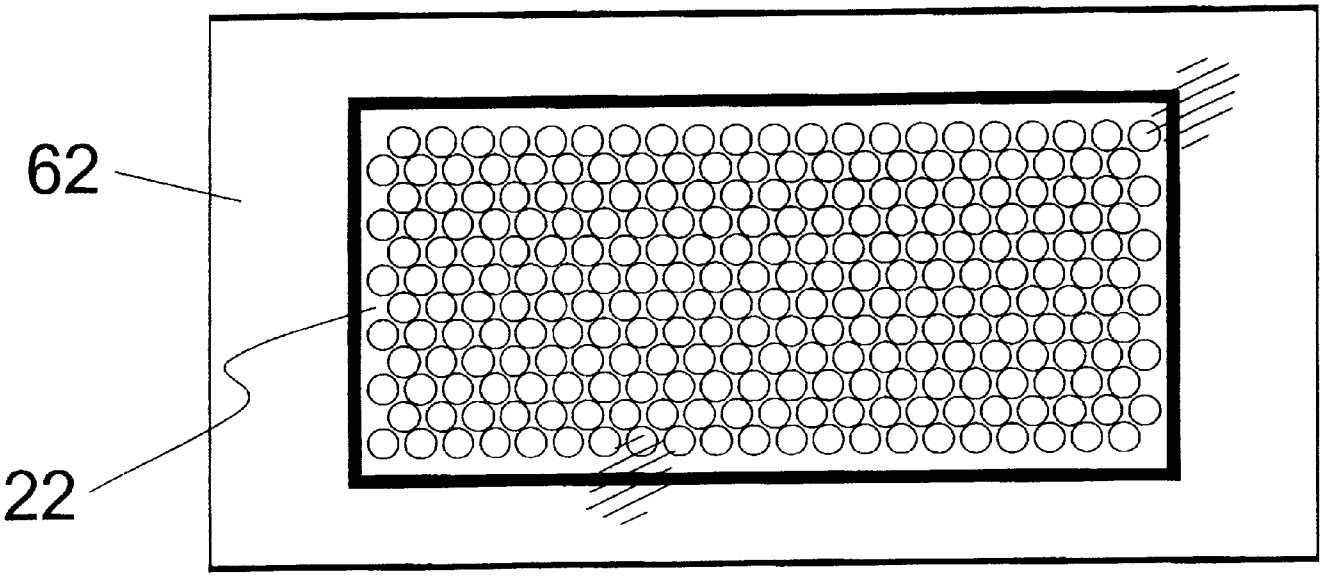
FIGS. 11A and 11B show both front and back views, respectively, of a further embodiment of this invention in the form of a smaller, more easily portable version of the invention.
Figure 11B:
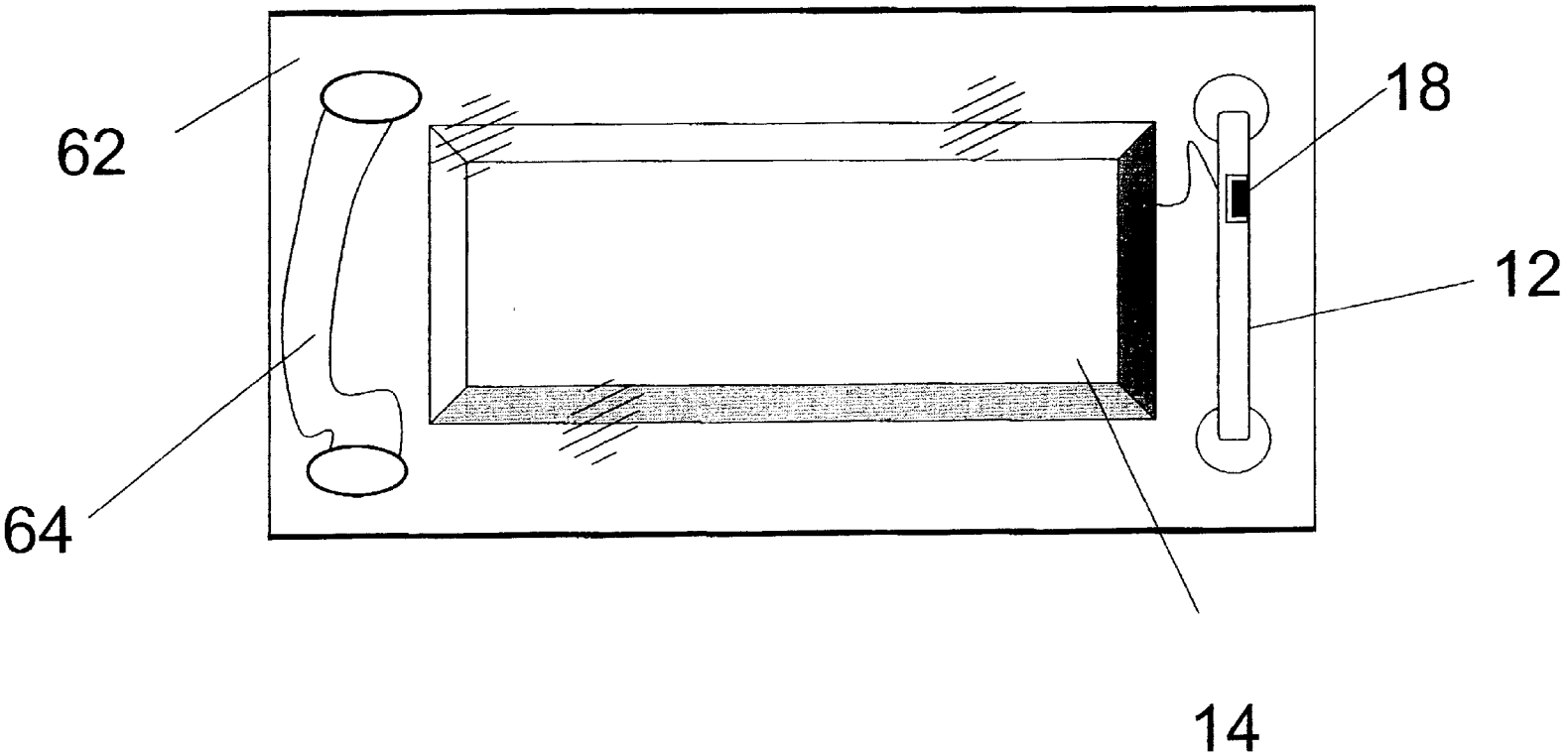

FIGS. 11A and 11B show a front and rear view of another embodiment of the present invention. This embodiment incorporates a small, high-impact plastic shield 62 (preferably clear) and an LED array 22 (made up of approximately 250 LEDs) which can be placed on the forearm (for instance The Barrier™, Handheld Protective Shield Device, U.S. Pat. No. 5,787,820). The LED array 22 is made up of one or more colors incorporating a variety of modes as described previously. This embodiment provides quick, immediate visual countermeasure. The shield 62 is secured to the user's arm by holding the handle 12 and allowing the canvas strap 64 to go around the arm, near the elbow. The unit is activated using the switch 18 located on the handle 12. Batteries and electronics are contained in the light housing 14. This embodiment would also be acceptable in a variety of other options including, but not limited to, a traffic clipboard, riot headgear, or other correction or law enforcement supplemental equipment.

Figure 12A:
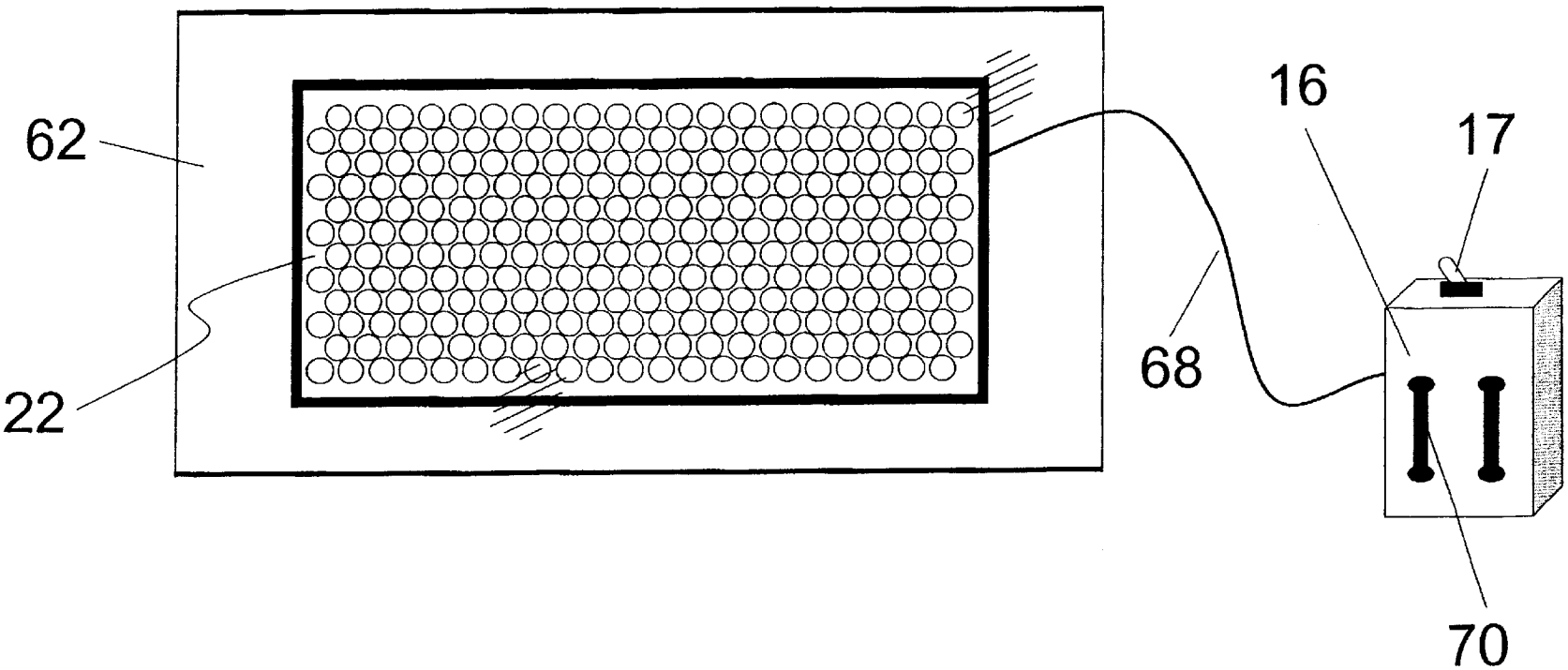
FIGS. 12A and 12B shows both front and back views, respectively, of another embodiment of this invention in the form of a smaller, more easily portable version of the invention with a detached battery/electronics pack.
Figure 12B:
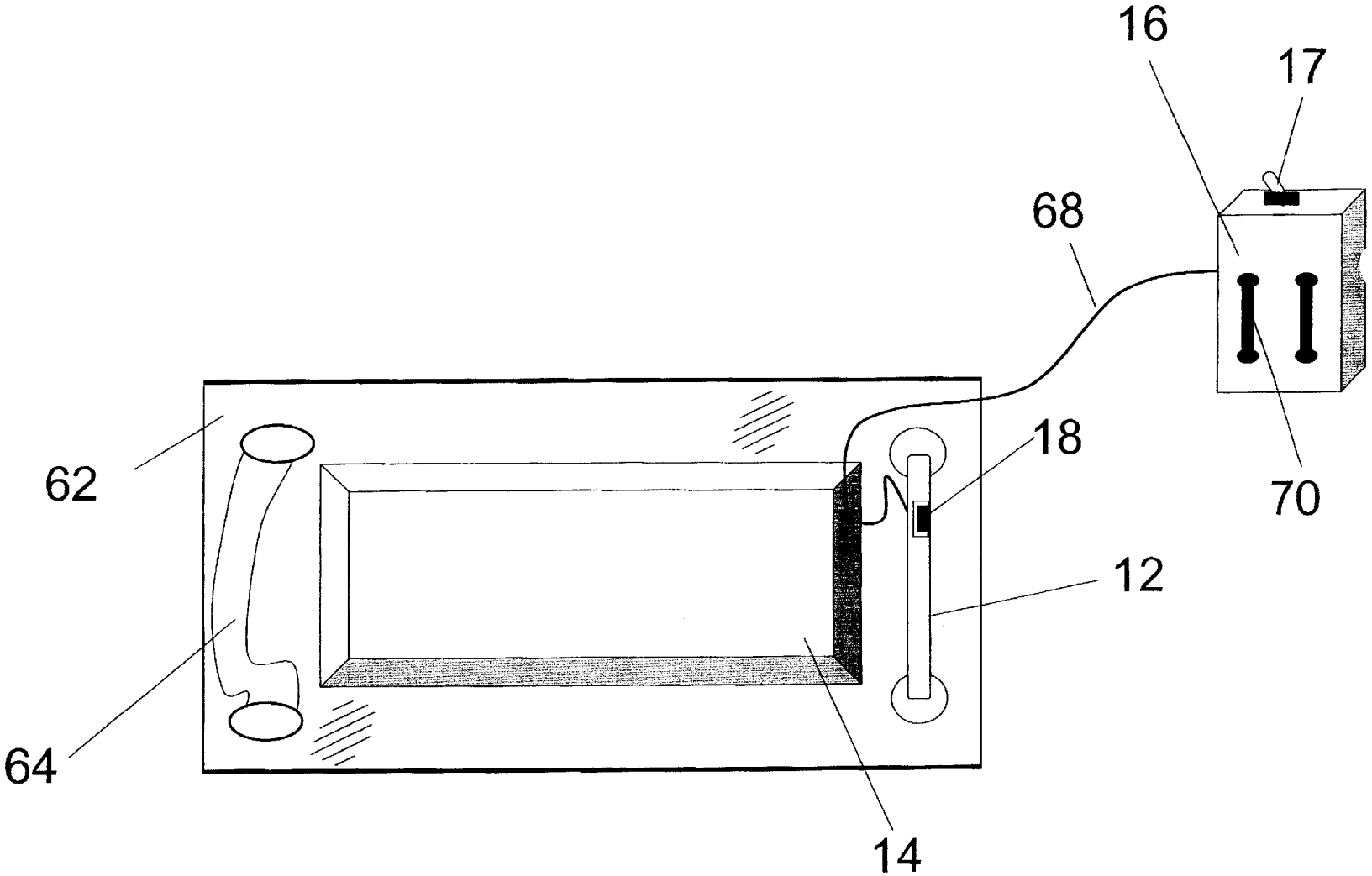

FIGS. 12A and 12B show an extension of the embodiment found in FIGS. 11A and 11B. The embodiment shown in FIGS. 12A and 12B use a detached battery/electronics housing 16 that can be clipped or attached to the user using loops/clips 70. The detached battery/electronics housing 16 incorporates the needed electronics and battery supply in a single unit. The main power switch 17 is located on the detached battery/electronics housing 16. Using wires 68, the detached battery/electronics housing is attached to the main light housing 14 and/or the action switch 18. This further embodiment provides a lightweight, agile, robust, handheld visual countermeasure. The actual position of switches may vary within the scope of the invention.

Figure 13:
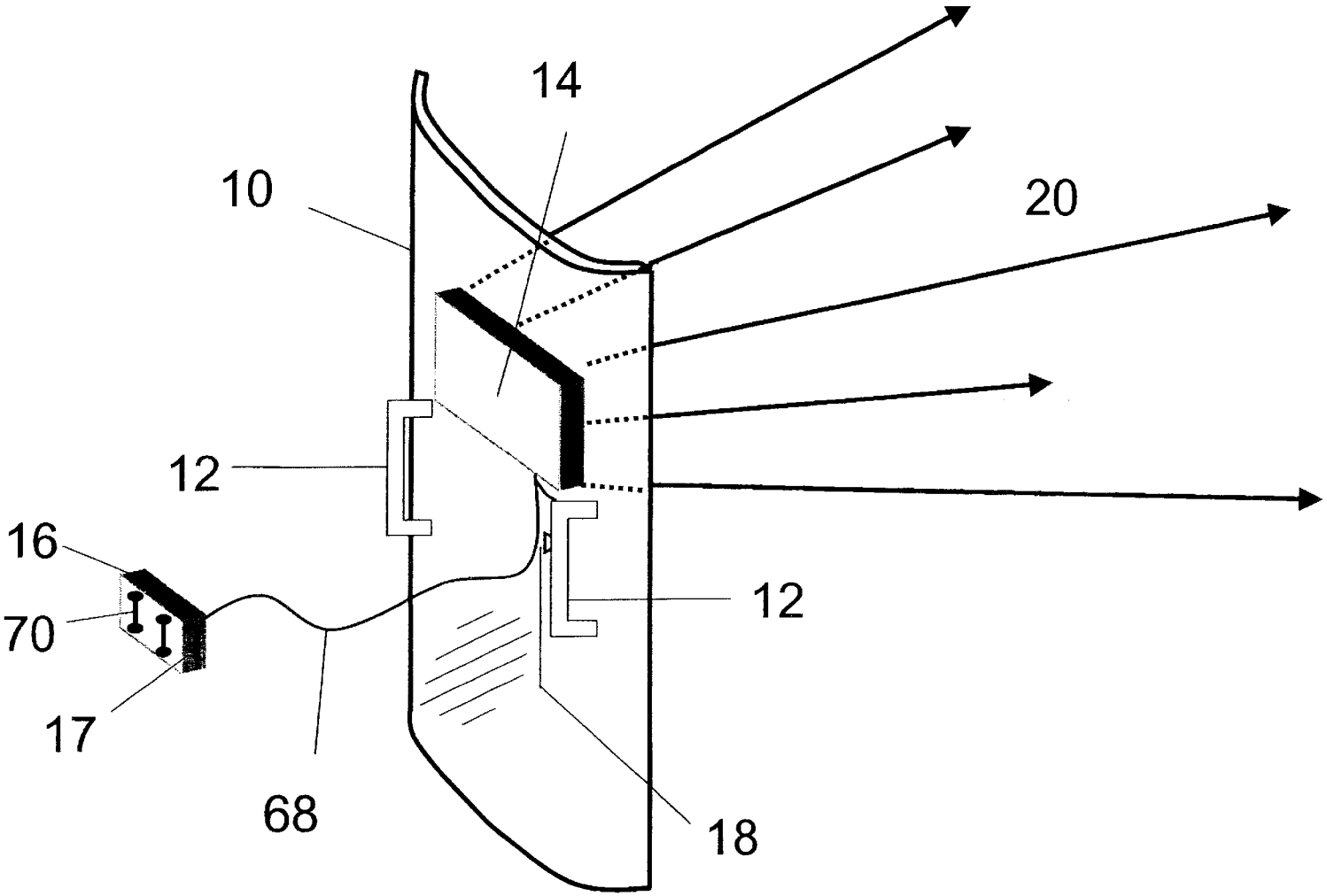
FIG. 13 shows a further embodiment of the present invention having a detached battery/electronics pack.

FIG. 13 illustrates an embodiment of the invention which incorporates therein the overall inventive concept as described with reference to FIG. 1. More specifically, making up this embodiment of the invention is a light housing 14 affixed and electrically connected to a detached battery housing 16 with a main power switch 17. The detached battery housing 16 can be attached to the user via securing means such as clips (not shown) or belt loops 70 located on the side of the housing 16. The detached battery housing 16 is connected via electrical wires 68 to the main light housing 14 which is connected to the action switch 18 as in the embodiment of FIG. 1. The action switch 18 located on one of the handles 12 is normally in the central, "power off" position. When the action switch 18 is pressed in one direction, the LED array turns on with continuous light output. It should be noted that the exact location of the switches may vary within the scope of the invention. The illumination 20 shines outward, away from the user, and is directed at the adversary. The main advantage to a detached battery/electronics housing is reduction in weight of the shield 10, thereby making the device easier to use and handle effectively.

Figure 14:
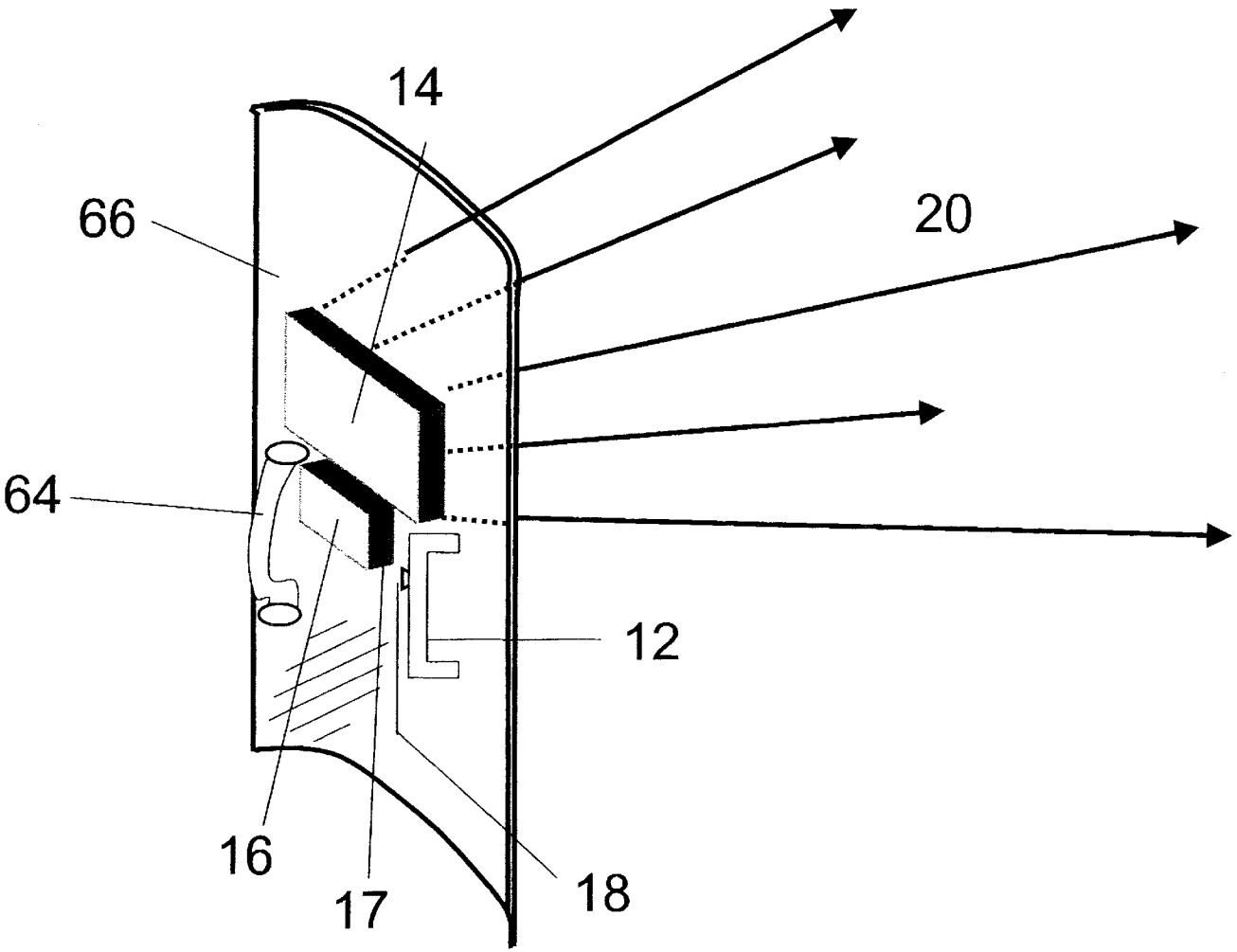
FIG. 14 shows a further embodiment of the present invention used as a riot shield.

In the preferred embodiment (shown in FIG. 1), a standard capture shield 10 is outfitted with the high-brightness array of the present invention. It is important to note that a standard riot shield, which curves in toward the user (convex on the exterior), may also be used as an effective riot control device. FIG. 14 shows this overall inventive concept. More specifically, the embodiment shown in FIG. 14 incorporates therein a standard riot shield 66 which is made of preferably clear, durable plastic (e.g., Lexan®) and is equipped with a sturdy handle(s) 12 and a canvas strap 64. Making up this embodiment is a light housing 14 affixed and electrically connected to a battery/electronics housing 16 with a main power switch 17 similar to that described with respect to FIG. 1. A three position action switch 18 located on one of the handles 12 is normally in the central, "power off" position. When the action switch 18 is pressed in one direction, the LED array turns on with continuous light output. When action switch 18 is pressed in the opposite direction, the LED array flickers on and off at a rate approximately between 4-40 times per second. The preferable rate is 18 flashes per second. If action switch 18 is positioned for either the continuous or flicker mode, then an instant bright light 20 is produced. The illumination 20 shines outward, away from the user, and is directed at the adversary. It should be noted that the exact location of the switch(es) may vary within the scope of the invention. Additionally, the type of switch may vary within the scope of the invention, for example, a single action switch could be used to produce only flicker mode or only continuous mode.

Figure 15:
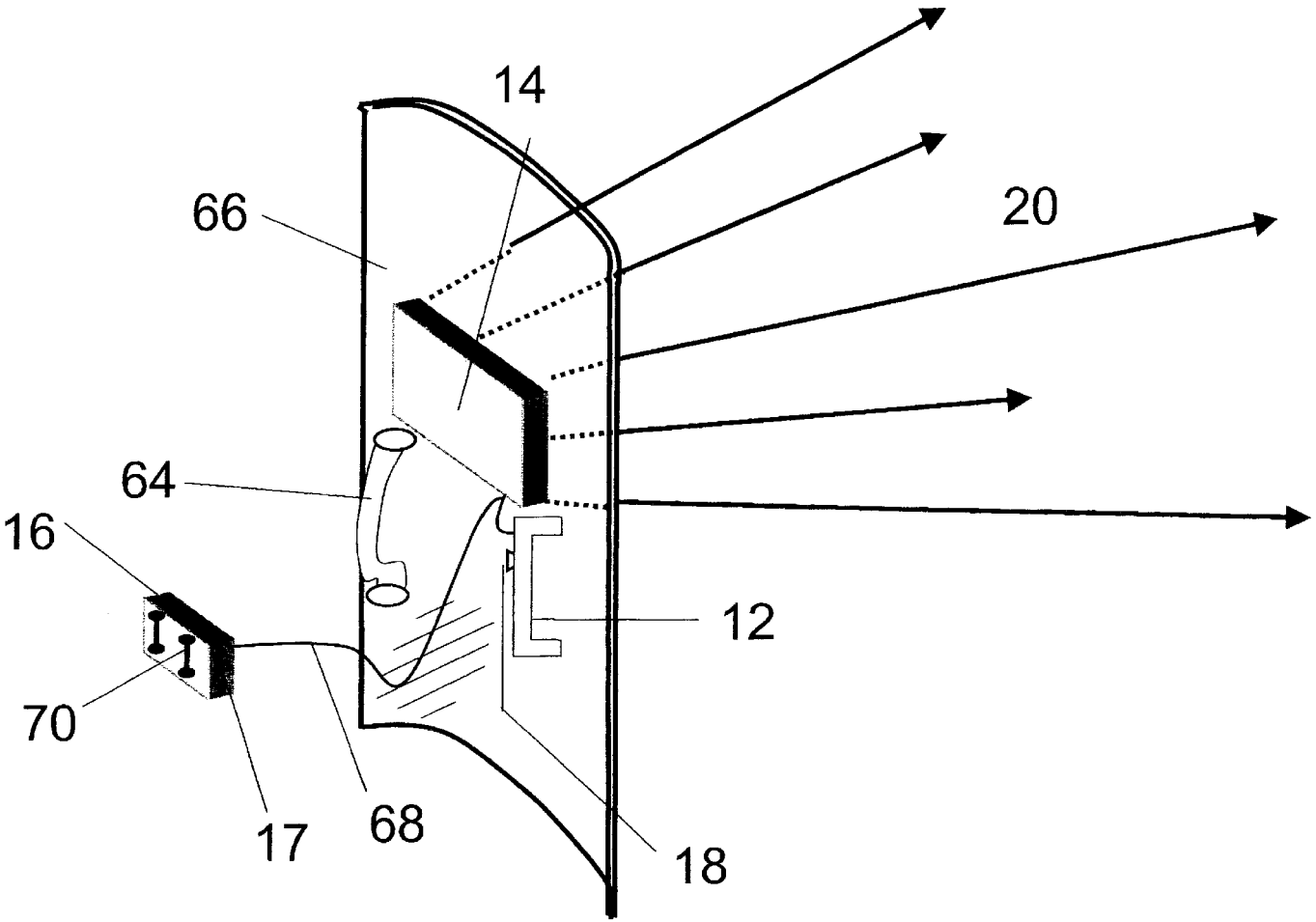
FIG. 15 shows a further embodiment of the present invention used as a riot shield and having a detached battery/electronics pack.

FIG. 15 shows a further embodiment which is an extension of the embodiment described above. In order to add versatility to the concept, the riot shield 66 can be equipped with the light array 14 and a detachable battery/electronics housing 16. The detachable battery/electronics housing 16 incorporates the main power switch 17 along with securing means such as clips/loops 70 for attachment to the user. Wire(s) 68 are used to provide connection between the light housing 14 and the detached battery/electronics housing 17.

Although the invention has been described with respect to various embodiments, it should be realized that this invention is also capable of a wide variety of further and other embodiments within the spirit and scope of the appended claims.

What is claimed is:

1. A device for aiding in the capture or control of at least one adversary, said device comprising:

a shield, said shield being made of a durable material, transparent to light of at least one preselected wavelength;

at least one array of high intensity light sources affixed to said shield;

said at least one array of light sources capable of controllably emitting said light at said at least one preselected wavelength;

means affixed to said shield for holding said shield in a predetermined relationship with respect to the at least one adversary;

means positioned with respect to said holding means for controlling operation of said at least one array of light sources, said controlling means being easily accessible by the user during operation of said device; and said controlling means for controlling the operation of said at least one array of light sources provides for a flicker mode and a continuous mode of light being directed outward from said shield away from the user toward the at least one adversary.

2. The device as defined in claim 1 wherein said shield has an interior side and an exterior side, and said at least one array of light sources being affixed on said interior side of said shield.

3. The device as defined in claim 1 wherein said light sources of said at least one array of light sources all emit light of the same color.

4. The device as defined in claim 1 wherein said light sources of said at least one array of light sources emit light of different colors.

5. The device as defined in claim 2 further comprising:

a housing, said housing having peripheral edges;

said at least one array of light sources being affixed within said housing; and means for affixing said housing with respect to said interior side of said shield to allow movement to take place between said shield and said housing.

6. The device as defined in claim 5 further comprising:

padding being affixed to said interior side of said shield adjacent said peripheral edges of said housing;

wherein under normal conditions said padding abuts said peripheral edges of said housing and under flexure of said shield said padding is displaced from said peripheral edges of said housing.

7. The device as defined in claim 1 wherein said light sources are in the form of a plurality of light emitting diodes (LEDs).

8. The device as defined in claim 7 wherein said plurality of LEDs are approximately 200–2000 in number.

9. The device as defined in claim 6 wherein said light sources are in the form of a plurality of light emitting diodes (LEDs).

10. The device as defined in claim 9 wherein said plurality of LEDs are approximately 200–2000 in number.

11. The device as defined in claim 1 wherein there are two arrays of high intensity light sources.

12. The device as defined in claim 4 wherein said controlling means controls flickering of said light sources to sequentially flash first one color light sources and then another color light sources in repeated cycles.

13. The device as defined in claim 4 wherein said controlling means comprises a multiposition switch and wherein in one position of said switch at least one of said light sources is on continually, in another position of said switch at least one of said light sources is flickering.

14. The device as defined in claim 13 wherein said flickering of said light sources comprises flickering selected light sources at different frequencies.

15. The device as defined in claim 1 wherein said controlling means further comprises:

a power supply housing, said power supply housing including therein a power source, a power supply circuit and a switch, all electrically interconnected to each other.

16. The device as defined in claim 15 wherein said power supply housing is affixed to said shield along a central vertical axis of said shield.

17. The device as defined in claim 1 wherein said shield has an interior side and an exterior side, and further comprising:

a housing;

said at least one array of light sources being affixed within said housing; and means for affixing said housing with respect to said exterior side of said shield.

18. The device as defined in claim 1 wherein said controlling means further comprises:

a power source, a power supply circuit and a switch, all electrically interconnected to each other.

19. The device as defined in claim 18 wherein said power source and said power supply circuit are located within a housing.

20. The device as defined in claim 1 wherein said holding means comprises at least one rigid handle.

21. The device as defined in claim 1 wherein said holding means comprises at least one flexible handle.

22. The device as defined in claim 1 wherein said controlling means further comprises:

a power source, a power supply circuit and a switch, all electrically interconnected to each other and wherein at least said power source is displaced from said shield.

23. The device as defined in claim 1 wherein said shield has an interior side and an exterior side, and said exterior side is concave.

24. The device as defined in claim 1 wherein said shield has an interior side and an exterior side, and said exterior side is convex.

25. A kit for use with a shield in order to provide for a device for aiding in the capture or control of at least one adversary, said kit including a set of components comprising:

at least one array of high intensity light sources, said at least one array of light sources capable of controllably emitting light of at least one color;

a housing for containing said at least one array of high intensity light sources;

a template, said template being designed to provide a guide for drilling holes in said shield to accommodate means for affixing said housing to said shield;

means for affixing said housing to said shield in a movable relationship to said shield;

means for controlling operation of said at least one array of light sources, said controlling means being capable of being operably interelated with said shield; and said controlling means for controlling the operation of said at least one array of light sources provides for a flicker mode and a continuous mode of light being directed outward from said shield away from a user of said shield toward the at least one adversary when said components are interconnected to said shield.

26. The kit as defined in claim 25 wherein said components further comprise protective padding capable of being used to protect said housing and the user of said shield.

27. A device for aiding in the capture or control of at least one adversary, said device comprising:

a shield, said shield made of a durable material being transparent to light in at least one preselected wavelength;

at least one high intensity light source affixed to said shield, said at least one light source capable of controllably emitting said light at said at least one preselected wavelength;

at least one handle affixed to said shield in order for a user of said device to hold said shield in a predetermined relationship with respect to the at least one adversary; and means positioned with respect to said at least one handle, easily accessible by the user during operation of said device, for controlling the operation of said light source such that said light is emitted outward from said shield toward the adversary in a flicker mode and a continuous mode.

28. The device as defined in claim 27 comprising a plurality of light sources and wherein said light sources all emit light of the same color.

29. The device as defined in claim 27 comprising a plurality of light sources and wherein said light sources emit light of different colors.

30. The device as defined in claim 27 further comprising:

a housing, said housing having peripheral edges;

said at least one light source being affixed within said housing; and means for affixing said housing with respect to an interior side of said shield to allow movement to take place between said shield and said housing.

31. The device as defined in claim 30 further comprising:

padding being affixed to said interior side of said shield adjacent said peripheral edges of said housing;

wherein under normal conditions said padding abuts said peripheral edges of said housing and under flexure of said shield said padding is displaced from said peripheral edges of said housing.

32. The device as defined in claim 27 wherein said at least one light source is in the form of at least one light emitting diode (LED).

33. The device as defined in claim 27 comprising a plurality of light sources of different colors and wherein said controlling means controls flickering of said light sources to sequentially flash first one color light sources and then another color light sources in repeated cycles.

34. The device as defined in claim 33 wherein said flickering of said light sources comprises flickering selected light sources at different frequencies.

35. A method of controlling the actions of at least one adversary comprising the steps of:

providing a shield, said shield made of a durable material being transparent to light in at least one preselected wavelength;

providing a plurality of high intensity light sources to said shield, said plurality of light sources capable of controllably emitting said light at said at least one preselected wavelength;

holding said shield in a position adjacent to the at least one adversary;

controlling the operation of said light sources such that said light is emitted outward from said shield in a flicker mode and/or a continuous mode in a direction toward the at least one adversary; and moving toward said at least one adversary during the step of controlling the operation of said light sources.

36. The method as defined in claim 35 further comprising the step of forcing the at least one adversary against a rigid object with said shield while controlling the operation of said light sources.

37. The method as defined in claim 35 wherein the step of controlling the operation of said light sources further comprises flickering selected light sources in an offset manner.

38. The method as defined in claim 35 wherein the step of controlling the operation of said light sources further comprises flickering selected light sources out of phase.

39. The method as defined in claim 35 wherein the step of controlling the operation of said light sources further comprises flickering selected light sources in phase.

40. The method as defined in claim 35 wherein the step of controlling the operation of said light sources further comprises flickering selected light sources at different frequencies.

* * * * *